US005379915A

United States Patent [19]

Hudspeth et al.

[11] Patent Number: 5,379,915

[45] Date of Patent: Jan. 10, 1995

[54] APPARATUS FOR STORING AND DISPENSING CHALK

[76] Inventors: Brett A. Hudspeth; Earl L. Hudspeth, both of 126 Margaret Dr., Beaver Falls, Pa. 15010

[21] Appl. No.: 114,769

[22] Filed: Aug. 31, 1993

[51] Int. Cl.[6] ..... B65H 9/04

[52] U.S. Cl. ..... 221/172; 221/175; 221/193; 221/281; 221/283; 221/100; 221/102; 206/443

[58] Field of Search ..... 221/134, 172, 175, 191, 221/193, 281, 283, 285, 97, 100, 102; 206/443, 214

[56] References Cited

U.S. PATENT DOCUMENTS

| | | | |
|---|---|---|---|
| 245,408 | 8/1881 | Sheldon | 221/175 X |
| 591,963 | 10/1897 | Galbraith | 221/303 |
| 1,113,476 | 10/1914 | Osmer | 221/281 X |
| 1,985,585 | 12/1934 | Stone | 206/462 |
| 2,371,845 | 3/1945 | Robison | 221/281 |
| 2,382,932 | 8/1945 | Young | 221/194 X |
| 2,799,399 | 7/1957 | Cannon | 221/285 X |
| 3,162,322 | 12/1964 | Gilbertson | 221/141 X |
| 3,263,860 | 8/1966 | Haas | 221/285 X |
| 3,533,536 | 10/1970 | Baxendale | 221/281 |
| 4,194,647 | 3/1980 | Spurrier | 221/97 |
| 4,510,770 | 4/1985 | Vella | 221/281 X |
| 5,046,639 | 9/1991 | Deberry | 221/127 |
| 5,069,361 | 12/1991 | Jeffway, Jr. et al. | 206/214 X |
| 5,131,562 | 7/1992 | Brown | 221/143 X |

FOREIGN PATENT DOCUMENTS

| | | | |
|---|---|---|---|
| 676852 | 11/1929 | France | 221/102 X |

*Primary Examiner*—Robert P. Olszewski
*Assistant Examiner*—Dean A. Reichard
*Attorney, Agent, or Firm*—Reed Smith Shaw & McClay

[57] ABSTRACT

Apparatus for storing and dispensing pieces of chalk, the apparatus comprising a container including an outside surface having an input port and an output port formed therein such that the output port is positioned other than directly beneath the input port, a chalk channel positioned within the container and connecting the input port to the output port such that the input port is located at a highest point of the channel and the output port is located at a lowest point of the channel, the channel having a width so as to allow each piece of chalk within the channel to contact no more than two other pieces of chalk in the channel, and a dispensing rack extending from the outside surface of the container proximate to the output port for holding at least one piece of chalk.

5 Claims, 2 Drawing Sheets

APPARATUS FOR STORING AND DISPENSING CHALK

FIELD OF THE INVENTION

The present invention relates to apparatus used to store and dispense pieces of chalk and particularly relates to apparatus that stores several pieces of chalk and dispenses one piece of chalk at a time.

BACKGROUND OF THE INVENTION

Classroom instruction oftentimes includes use a blackboard on which the information being taught is written in chalk. A typical piece of chalk used by instructors to write on blackboards is usually shaped to fit comfortably in an instructor's hand and is generally cylindrically-shaped, having, for example, a length of approximately three and one-half inches (3½") and a diameter of three-eights of an inch (⅜").

A typical blackboard known in the art includes a tray attached to the bottom edge of the blackboard on which pieces of chalk are placed when not in use. The tray normally extends the entire length of the blackboard resulting in pieces of chalk being scattered about the tray, thus, requiring the instructor to search for a piece of chalk before being able to write on the blackboard. Further, oftentimes chalk pieces break when being placed on the tray or falling out of the tray onto the floor. In addition, when the blackboard is washed, cleaning fluid oftentimes runs down the surface of the blackboard and settles into the tray, thus, wetting the pieces of chalk the tray. The chalk pieces must dry before they can be used to adequately write on the blackboard.

Thus, an apparatus for storing and dispensing unbroken chalk pieces at a centralized location, preferably at or near a blackboard, is desirable. Further, it is desirable to have apparatus which keeps chalk pieces dry when the blackboard is washed.

Several devices are known in the art for storing and dispensing generally cylindrical-shaped objects. For example, U.S. Pat. No. 591,963 teaches a device for storing and dispensing toothpicks, U.S. Pat. No. 1,985,585 teaches a device for storing and dispensing cigars and cigarettes, and U.S. Pat. No. 2,382,932 teaches a device for storing and dispensing welding rods. Each of these devices includes a storage compartment that allows the cylindrical items loaded into and dispensed from such device to contact and knock against several other items within the storage compartment. These devices are not appropriate for storing and dispensing chalk pieces because each chalk piece is likely to, due to its brittle nature, break or otherwise become damaged when it contacts and knocks against several other pieces of chalk while it is being loaded into or dispensed from such devices.

U.S. Pat. No. 5,046,639 teaches a device for storing and dispensing flares having a generally vertical storage compartment. This device is not appropriate for storing and dispensing chalk pieces because the substantially vertical contact force exerted on the chalk pieces when the chalk pieces are being loaded into the substantially vertical storage compartment is likely to break or otherwise damage the chalk pieces. Further, chalk pieces may also break or otherwise become damaged if they become jammed in the spring loaded dispensing mechanism taught in that patent.

SUMMARY OF THE INVENTION

The apparatus of the invention is used for storing and dispensing pieces of chalk. The apparatus comprises a container including an outside surface having formed therein an input port for receiving chalk pieces one at a time and an output port for dispensing chalk pieces one at a time. The output port is located at the outside surface of the container other than directly beneath the input port.

A chalk channel is positioned within the container and connects the input port to the output port such that the input port is located at a highest point of the channel and the output port is located at a lowest point of the channel. The channel has a width that allows each piece of chalk loaded into the channel via the input port to contact no more than two other pieces of chalk in the channel. A dispensing rack extends from the outside surface of the container proximate to the output port for holding at least one piece of chalk until removed. In a preferred embodiment, the dispensing rack includes a finger notch formed therein to assist the removal of each piece of chalk from the dispensing rack.

In another preferred embodiment, the chalk storage and dispensing apparatus includes a chalk alignment opening formed in the outside surface of the container which connects the input port and the output port. The chalk alignment opening allows access to the chalk channel so that the user may align the loaded pieces of chalk, or remove broken pieces of chalk that may have been inadvertently loaded into the chalk channel, without the necessity of removing all of the chalk pieces from the apparatus.

In another preferred embodiment, the chalk storage and dispensing apparatus includes a subcompartment located within the container for storing additional pieces of chalk and an access port formed in the outside surface of the container for permitting access to the subcompartment. The chalk storage and dispensing apparatus may also include means for attaching the apparatus to a surface, such as a wall or desk top.

DETAILED DESCRIPTION

The chalk storage and dispensing apparatus of the invention stores and dispenses unbroken pieces of chalk at a centralized location while keeping chalk pieces dry when the blackboard is washed.

Figure 1:
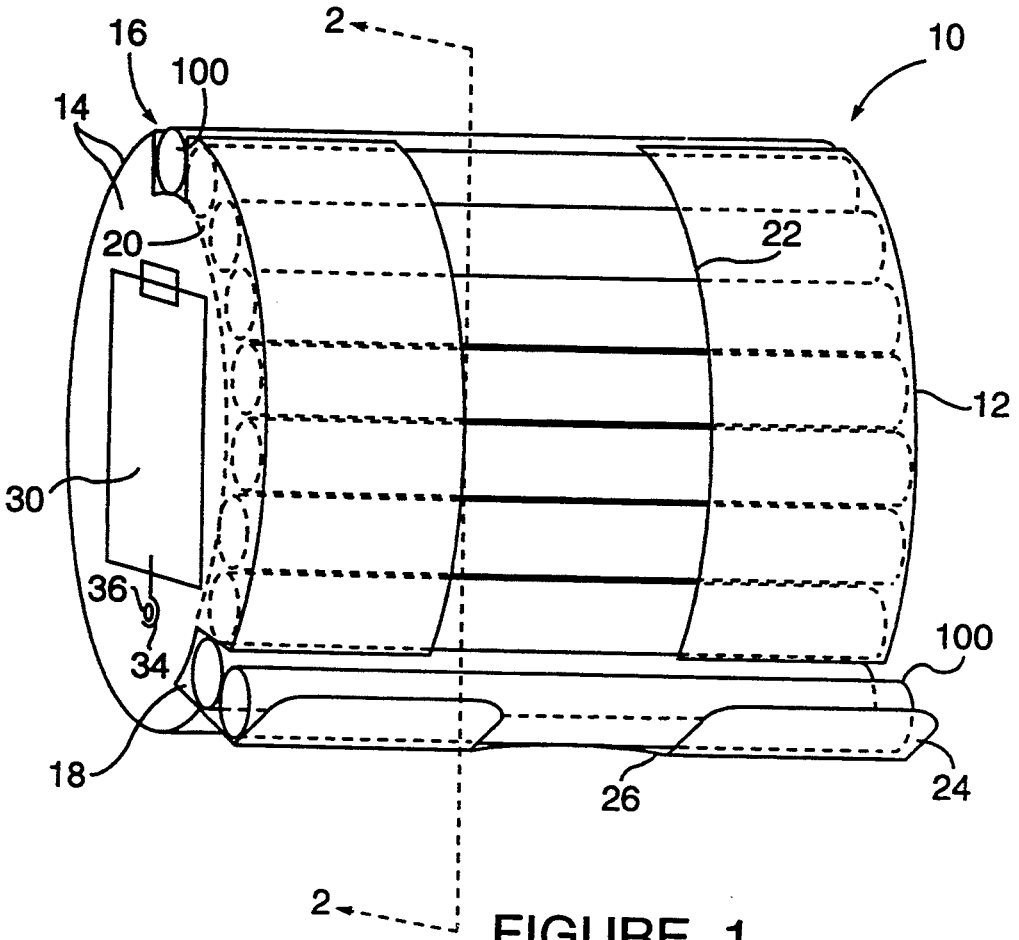
FIG. 1 is a front perspective view of a preferred embodiment of the chalk storage and dispensing apparatus of the invention.

A front perspective view of a preferred embodiment of the chalk storage and dispensing apparatus 10 of the invention is shown in FIG. 1. The chalk storage and dispensing apparatus 10 comprises a generally cylindrical container 12 including an outside surface 14 having an input port 16 and an output port 18 formed therein. The input port 16 is sized so as to receive one piece of chalk 100 at a time and the output port 18 is sized so as to dispense one piece of chalk 100 at a time. In a preferred embodiment, the pieces of chalk are generally cylindrical in shape.

Figure 2:
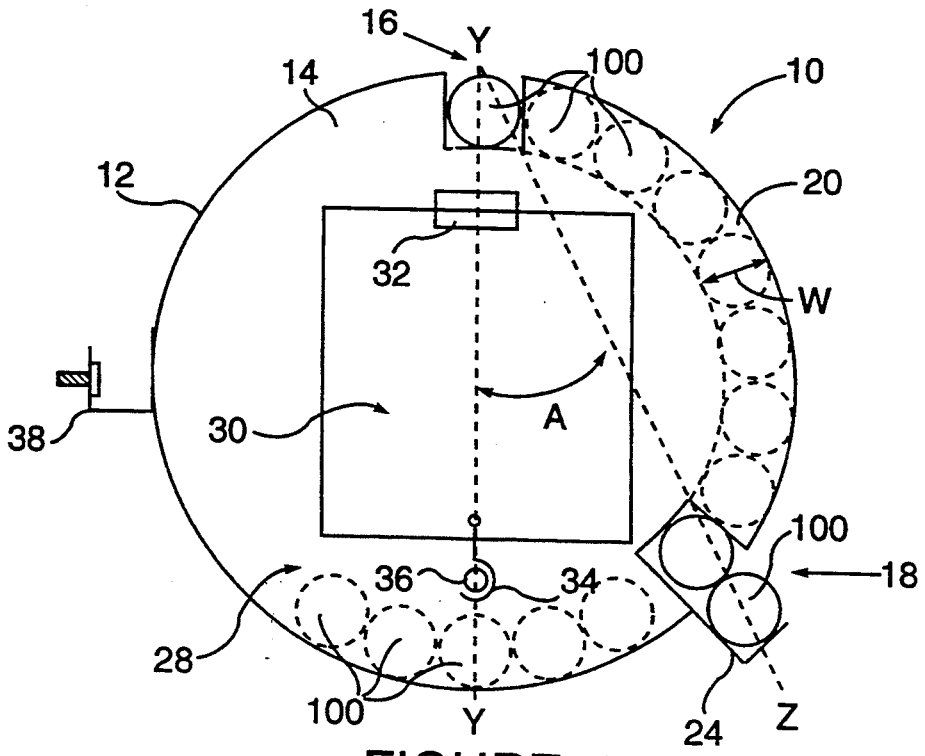
FIG. 2 is a cross-sectional view of the chalk storage and dispensing apparatus shown in FIG. 1 viewed along line 2—2 of FIG. 1.

The chalk storage and dispensing apparatus 10 of the invention further includes a chalk channel 20 located within the container 12 which connects the input port 16 to the output port 18 such that the input port 16 is located at a highest point of the channel 20 and the output port 18 is located at a lowest point of the channel 20. In a preferred embodiment, the output port 18 is positioned at the outside surface 14 of container 12 other than directly beneath the input port 16. More particularly, as shown in FIG. 2, the location of the output port 18 with respect to the input port 16 defines a dispensing angle A formed by a vertical axis Y—Y passing through the center of the input port 16 and a line Y-Z connecting the centers of the input port 16 and output port 18, respectively. The dispensing angle A should be greater that 0° but not exceed 90° (with reference to line Y—Y) so as to reduce the vertical contact force acting on the chalk pieces 100, and thus, the possibility of the chalk pieces breaking, as the chalk pieces 100 are being loaded into the chalk channel 20 via input port 16. In a preferred embodiment, the channel 20 forms an arcuate path and includes a width W sufficient to allow each piece of chalk 100 to travel freely within the channel 20 via the force of gravity, but not to contact more than two other pieces of chalk 100 within the channel 20.

In another preferred embodiment of the invention, the chalk storage and dispensing apparatus 10 further includes a chalk alignment channel 22 formed in the outside surface 14 of the container 12 connecting the input port 16 and output port 18. The chalk alignment channel 22 allows access to the chalk channel 20 so that the user may align the pieces of chalk 100 loaded into the channel 20 and remove any broken pieces of chalk 100 that may have been inadvertently loaded into the channel 20.

The chalk storage and dispensing apparatus 10 of the invention further includes a dispensing rack 24 attached to the outside surface 14 of the container 12 proximate the output port 18 so as to hold at least one piece of chalk exiting the output port 18 via the force of gravity. The dispensing rack 24 allows for easy access to one piece of chalk and may include a finger notch 26, preferably formed at an outside edge of the dispensing rack 24, for assisting the user in removing a piece of chalk 100 held in the dispensing rack 24.

In another preferred embodiment of the invention, the chalk storage and dispensing apparatus includes a subcompartment 28 located within the container 12 for storing used, broken or extra pieces of chalk 100. Access to the subcompartment 28 is provided by an access port, such as door 30, pivotally hinged to the outside surface 12 by hinge means 32 and held in the closed position by a movable clasp 34 engaging pin 36.

The apparatus may also include attachment means such as bracket and bolt 38, for attaching the apparatus to a surface, such as a wall or desk top (not shown).

Figure 3:
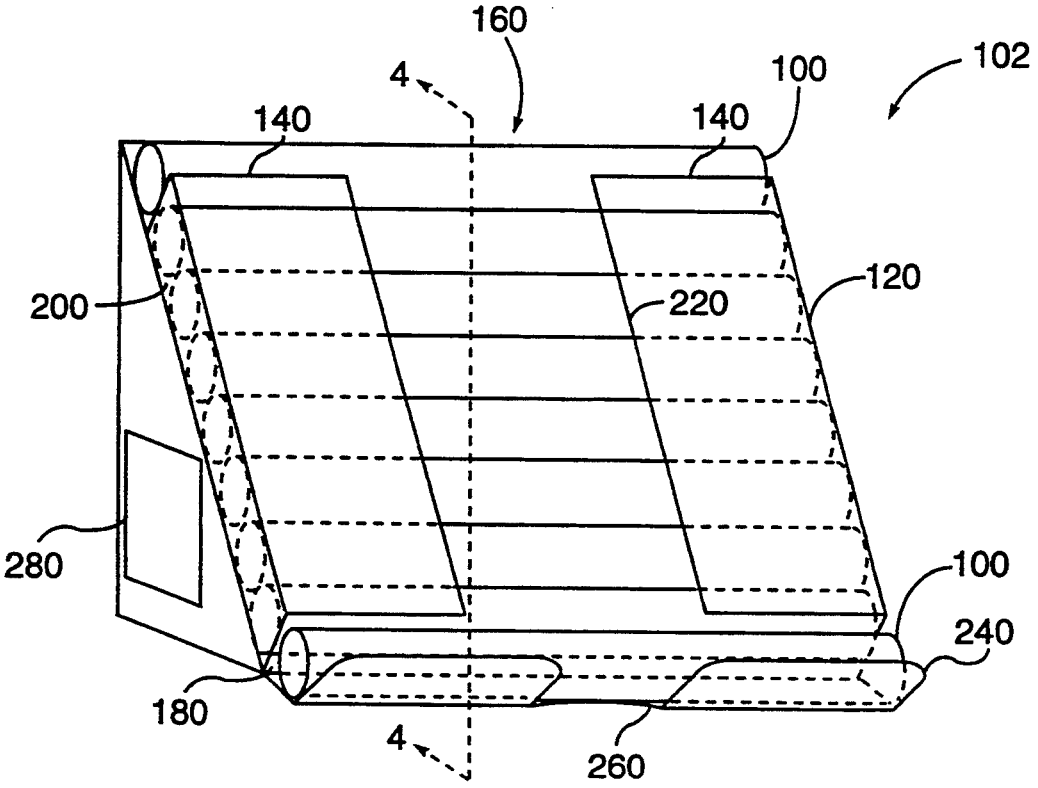
FIG. 3 is a front perspective view of another preferred embodiment of the chalk storage and dispensing apparatus of the invention.
Figure 4:
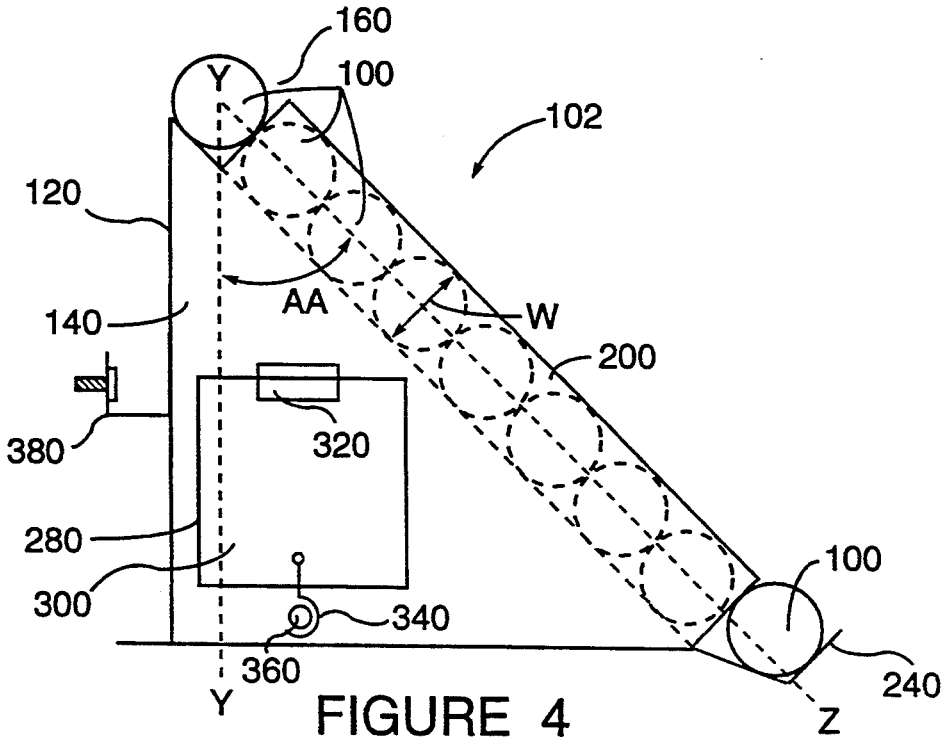
FIG. 4 is a cross-sectional view of the chalk storage and dispensing apparatus shown in FIG. 3 viewed along line 4—4 of FIG. 3.

Another preferred embodiment of the invention 102 is shown in FIGS. 3 and 4. In particular, the chalk storage and dispensing apparatus 102 of this embodiment comprises a generally triangular container 120 including an outside surface 140 having an input port 160 and an output port 180 formed therein. The input port 160 is sized so as to receive one piece of chalk 100 at a time and the output port 180 is sized so as to dispense one piece of chalk 100 at a time.

The chalk storage and dispensing apparatus 102 of the invention further includes a chalk channel 200 located within the container 120 which connects the input port 160 to the output port 180 such that the input port 160 is located at a highest point of the channel 200 and the output port 180 is located at a lowest point of the channel 200. As shown in FIG. 4, the input port 160 is located at the top end of the channel 200 and the output port 180 is located at the bottom end of the channel 200.

In a preferred embodiment, the output port 180 is positioned at the outside surface 140 of container 120 other than directly beneath the input port 160. More particularly, as shown in FIG. 4, the location of the output port 180 with respect to the input port 160 defines a dispensing angle AA formed by a vertical axis Y—Y passing through the center of the input port 160 and a line Y-Z connecting the centers of the input port 160 and output port 180, respectively. The dispensing angle AA should be greater that 0° but not exceed 90° (with reference to line Y—Y) so as to reduce the vertical contact force acting on the chalk pieces 100, and thus, the possibility of the chalk pieces breaking, as the chalk pieces 100 are being loaded into the chalk channel 200 via input port 160. In a preferred embodiment, the channel 200 forms an angled path and includes a width W sufficient to allow each piece of chalk 100 to travel freely within the channel 200 via the force of gravity, but not to contact more than two other pieces of chalk 100 within the channel 200.

In another preferred embodiment of the invention, the chalk storage and dispensing apparatus 102 further includes a chalk alignment channel 220 formed in the outside surface 140 of the container 120 connecting the input port 160 and output port 180. The chalk alignment channel 220 allows access to the chalk channel 200 so that the user may align the pieces of chalk 100 loaded into the channel 200 and remove any broken pieces of chalk 100 that may have been inadvertently loaded into the channel 200.

The chalk storage and dispensing apparatus 102 of the invention further includes a dispensing rack 240 attached to the outside surface 140 of the generally triangular container 120 proximate the output port 180 so as to hold at least one piece of chalk exiting the output port 180 via the force of gravity. The dispensing rack 240 allows for easy access to one piece of chalk and may include a finger notch 260, preferably formed at an outside edge of the dispensing rack 240, for assisting the user in removing a piece of chalk 100 held in the dispensing rack 240.

In another preferred embodiment of the invention, the chalk storage and dispensing apparatus 102 includes a subcompartment 280 located within the container 120 for storing used, broken or extra pieces of chalk 100. Access to the subcompartment 280 is provided by an access port, such as door 300, pivotally hinged to the outside surface 120 by hinge means 320 and held in the closed position by a movable clasp 340 engaging pin 360.

The apparatus may also include attachment means such as bracket and bolt 380, for attaching the apparatus to a surface, such as a wall or desk top (not shown).

The chalk storage and dispensing apparatus of the invention may be made of any suitable material, for example, plastic, metal or a recyclable material, such as cardboard.

Although the invention has been described in detail for the purpose of illustration, it is to be understood that such detail is solely for that purpose and that variations can be made therein by those skilled in the art without departing from the spirit and scope of the invention except as it may be limited by the claims. In particular, the container of the chalk storage and dispensing apparatus of the invention may be of any desired shape and the chalk channel may form any desired path.

What is claimed is:

1. Apparatus for storing and dispensing generally cylindrically-shaped pieces of chalk, the apparatus comprising:

a container including an outside surface having an input port sized for receiving only one piece of chalk at a time and an output port sized for dispensing only one piece of chalk at a time formed therein such that the output port is positioned other than directly beneath the input port;

a chalk channel free of any vertical sections, positioned within the container and connecting the input port to the output port such that the input port is located at a highest point of the channel and the output port is located at a lowest point of the channel, the channel having a width so as to allow each piece of chalk within the channel to contact no more than two other pieces of chalk in the channel, whereby each piece of chalk is substantially at all times afforded vertical support by the channel throughout passage within the channel; and a dispensing rack extending from the outside surface of the container proximate to the output port sized for holding only one piece of chalk such that one piece of chalk at a time enters the dispensing rack under a gravitational force.

2. The chalk storage and dispensing apparatus of claim 1 further comprising:

a chalk alignment opening formed in the outside surface of the container and connecting the input port and the output port for allowing access to the chalk channel.

3. The chalk storage and dispensing apparatus of claim 1 further comprising:

a finger notch formed within the dispensing rack.

4. The chalk storage and dispensing apparatus of claim 1 further comprising:

a subcompartment located within the container for storing pieces of chalk; and an access port formed in the outside surface of the container for permitting access to the subcompartment.

5. The chalk storage and dispensing apparatus of claim 1 further comprising:

means for attaching the apparatus to a surface.

* * * * *